US006989484B2

(12) United States Patent
Gross

(10) Patent No.: US 6,989,484 B2
(45) Date of Patent: Jan. 24, 2006

(54) CONTROLLING SHARING OF FILES BY PORTABLE DEVICES

(75) Inventor: Mark T. Gross, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 691 days.

(21) Appl. No.: 09/836,686

(22) Filed: Apr. 17, 2001

(65) Prior Publication Data

US 2002/0148343 A1 Oct. 17, 2002

(51) Int. Cl.
*A63H 5/00* (2006.01)
*G04B 13/00* (2006.01)
*G10H 7/00* (2006.01)

(52) U.S. Cl. ..... 84/609; 84/600; 84/649
(58) Field of Classification Search ..... 84/600–602, 84/609–610, 634, 645, 649–650, 666
See application file for complete search history.

(56) References Cited

U.S. PATENT DOCUMENTS 6,192,340 B1 * 2/2001 Abecassis ..... 704/270
6,219,669 B1 * 4/2001 Haff et al. ..... 707/10
6,247,130 B1 * 6/2001 Fritsch ..... 713/171
6,282,653 B1 * 8/2001 Berstis et al. ..... 713/200
6,317,793 B1 * 11/2001 Toyosawa ..... 709/228
6,323,893 B1 * 11/2001 Tosaya ..... 348/14.08
6,324,378 B1 * 11/2001 Schlossberg ..... 434/307 R
6,332,175 B1 * 12/2001 Birrell et al. ..... 711/112

OTHER PUBLICATIONS

SDMI Secure Digital Music Initiative, DSMI Portable Device Specification, Part 1, Version 1.0, Jul. 8, 1999, Document No. pdwg99070802, 35 pages.

* cited by examiner

*Primary Examiner*—Marlon Fletcher
(74) *Attorney, Agent, or Firm*—Trop, Pruner & Hu, P.C.

(57) ABSTRACT

A way of controlling sharing of files by portable devices is provided. A portable device is provided that comprises an interface to receive at least one file and a transfer count associated with the file from another device. The portable device further includes a controller that is communicatively coupled to the interface, the controller to allow transfer of the file based on the associated transfer count.

16 Claims, 6 Drawing Sheets

220

| FILE # | TITLE | TRANSFER COUNT |
|---|---|---|
| 1 | FIRST MUSIC FILE | 4 |
| 2 | SECOND MUSIC FILE | 2 |
| 3 | THIRD MUSIC FILE | 2 |
| ••• | | |
| M | M -- MUSIC FILE | 4 |

420(1)
420(2)
420(3)
420(m)

FIG. 5A (FILE TABLE ON THE TRANSMITTING PORTABLE DEVICE BEFORE TRANSFER)

220

| FILE # | TITLE | TRANSFER COUNT |
|---|---|---|
| 1 | FIRST MUSIC FILE | 3 |
| 2 | SECOND MUSIC FILE | 2 |
| 3 | THIRD MUSIC FILE | 1 |
| ••• | | |
| M | M -- MUSIC FILE | 4 |

420(1)
420(2)
420(3)
420(m)

FIG. 5B (FILE TABLE ON THE TRANSMITTING PORTABLE DEVICE AFTER TRANSFER)

220

| FILE # | TITLE | TRANSFER COUNT |
|---|---|---|
| 1 | FIRST MUSIC FILE | 0 |
| 2 | SECOND MUSIC FILE | 0 |
| 3 | FAV MUSIC FILE | 4 |
| ••• | | |
| G | G -- MUSIC FILE | 2 |

420(1)
420(2)
420(3)
420(g)

FIG. 5C (FILE TABLE ON THE RECEIVING PORTABLE DEVICE AFTER TRANSFER)

CONTROLLING SHARING OF FILES BY PORTABLE DEVICES

BACKGROUND

This invention relates generally to controlling sharing of files by portable devices, and, more particularly, to controlling sharing of music files by portable music players.

Personal electronic devices of various types have become prevalent in everyday use. For example, it is not uncommon to find consumers today using cellular phones, personal digital assistants (PDAs), pagers, portable music players such as MP3 (Moving Pictures Expert Group, Layer 3) players, and other types of music players.

The availability of digital music today may be one reason portable music players have become popular amongst music fans. In some cases, digital music is stored in digital files that may be readily exchanged by users. Currently, transferring digital music files from one music player to another typically involves a host, usually a personal computer or network. For example, a user may transfer a music file from a host to one or more music players. Transfers may include making copies of the file, or, alternatively, moving the original file.

To discourage unauthorized copying and playing of digital audio content, a variety of secure mechanisms have been proposed, including Secure Digital Music Initiative (SDMI). The SDMI Portable Device Specification Part 1, Version 1.0, document No. pdwg99070802, published Jul. 8, 1999. While SDMI may contribute in reducing unauthorized transfers of files from a host computer to a portable music device, it may not necessarily be as effective in controlling unauthorized transfers of music files between portable music devices.

Thus, there is a need to control sharing of music files by portable music devices.

BRIEF DESCRIPTION OF THE DRAWINGS

The invention may be understood by reference to the following description taken in conjunction with the accompanying drawings, in which like reference numerals identify like elements, and in which:

FIGS. 5A–5C illustrate one embodiment of a file table that may be stored on the portable device of FIG. 3.

DETAILED DESCRIPTION

Figure 1:
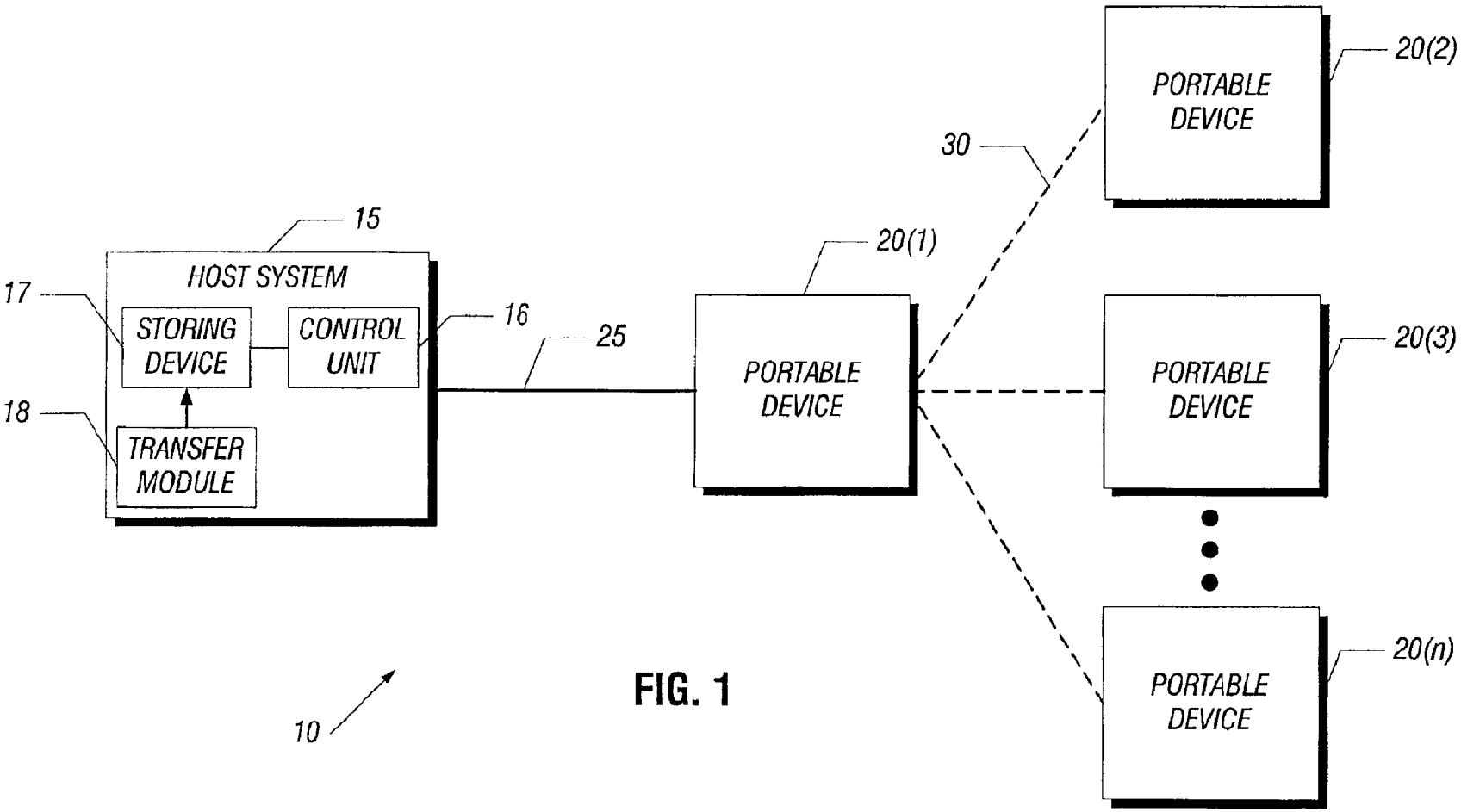
FIG. 1 is a stylized block diagram of a communications system, in accordance with one embodiment of the present invention.

Referring now to FIG. 1, a block diagram of a communications system 10 is shown in accordance with one embodiment of the present invention. The communications system 10, in one embodiment, includes a host system 15 having a control unit 16 coupled to a storing device 17. The host system 15 may include a transfer module 18 that may be resident in the storage device 17 of the host system 15. As described in more detail below, the transfer module 18 may be capable of transferring one or more files stored in the storage device 17 of the host system to one or more portable devices **20(1-*n*). A "file" may contain, in one embodiment, any form of data for which it may be desirable to control transfer access, such as controlling the number of times the file may be transferred between portable devices 20(1-*n*)**. Although not so limited, in the illustrated embodiments, the files are music files having digital music data stored therein.

In one embodiment, the host system 15 may be compliant with a standard that allows for secure distribution of music. For example, the host system 15 may be a SDMI compliant system, where music files are first imported into a SDMI domain before being stored in the storage device 17 of the host system 15. The SDMI domain typically refers to a subset of the environment where the SDMI rules and behaviors are obeyed. One SDMI rule, for example, calls for the music file to be first watermark screened before the music file can be stored in the SDMI domain. Typically, after the watermark screening, the contents of the music file are encrypted and then stored in the storage unit 17, where the encrypted file may later be transferred to other portable devices **20(1-*n*)**.

The host system 15 may be one of a variety of processor-based systems that is capable of storing and/or transmitting digital music to one or more of the portable devices **20(1-*n*). As described in more detail below, the host system 15, in one embodiment, is capable of transmitting a transfer count associated with each transmitted music file to the portable device 20(1), where the transfer count, in one embodiment, may represent the number of times a particular music file may be shared by (or transferred from) the portable device 20(1). The host system 15 may be a laptop computer, a desktop computer, a main frame computer, or any other processor-based device. The portable device 20(1-*n*) may be any one of a variety of devices capable of exchanging one or more files, including a portable music player, cellular phone, personal digital assistant (PDA), pager, and the like. In one embodiment, the cellular phone, PDA, and pager may be capable of playing the contents stored in one or more music files. In one embodiment, the portable device 20(1-*n*)** may be a battery powered device.

Although any one of the portable devices **20(1-*n*) of FIG. 1 may be capable of receiving files from the host system 15, for ease of illustration, in the illustrated embodiment, the portable device 20(1) is shown to receive one or music files from the host system 15 over a connection 25. The connection 25 may be, in one embodiment, any type of standardized connection with established protocols, such as infrared (IR), universal serial bus (USB), or other wired or wireless connections. Once the portable device 20(1) receives the one or more music files from the host system 15, these music files may then be transferred from the portable device 20(1) (also referred to as the "transmitting portable device") to one or more of the other portable devices 20(2-*n*) (also referred to as "receiving portable devices"). For ease of illustration, in the illustrated embodiment the transmitting device 20(1) is shown as transmitting music files to other portable devices 20(1-*n*), although it should be understood that, in other embodiments, any pair of the portable devices 20(1-*n*)** may be the transmitting or receiving device.

In accordance with one embodiment of the present invention, the transmitting portable device 20(1) may be communicatively coupled to one or more of the receiving portable devices **20(2-*n*) over a connection 30. The connection 30 may be a wired or wireless connection over which the portable devices 20(1-*n*)** may communicate with each other, including exchanging, in one embodiment, one or more music files and a transfer count associated with each of the music files, as described in more detail below.

Figure 2:
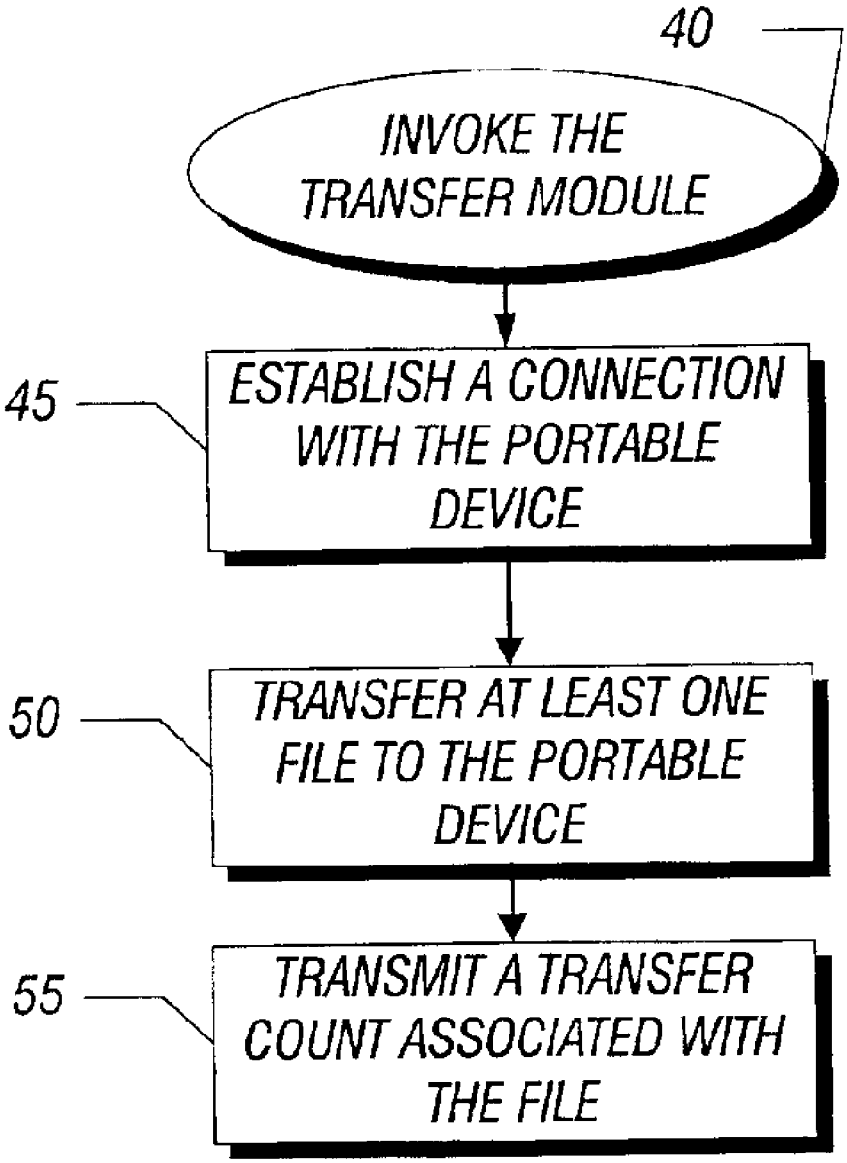
FIG. 2 is a flow chart of one embodiment of software resident on a host system in the communications system of FIG. 1.

Referring now to FIG. 2, a flow chart of the transfer module 18 is illustrated in accordance with one embodiment of the present invention. The transfer module 18 may be invoked (at 40) when a user wishes to transfer one or more music files from the host system 15 to the portable device 20(1). The transfer module 18, in one embodiment, establishes (at 45) a connection with the portable device 20(1). In one embodiment, establishing (at 45) the connection may include verifying a secure and compatible connection. For example, if transferring a SDMI-authenticated music file, the host system 15 may ensure that the remote portable device 20(1) is SDMI compliant.

The host system 15 transfers (at 50) at least one file to the portable device 20(1). In one embodiment, the transferred file may be encrypted in accordance with the SDMI specification. Along with the transferred file, the host system 15 may transmit (at 55) a transfer count associated with the file, where the transfer count may, for example, indicate the number of times the portable device 20(1) may transfer the received file to other devices, such as other portable devices **20(2-*n*)**. In one embodiment, the transfer count may be encoded in the contents of the music file such that the transfer count is transmitted along with the music file. In an alternative embodiment, instead of being embedded in the music file, the transfer count may be transmitted before or after the file is transferred. In one embodiment, the transfer count may be encrypted to prevent tampering.

Figure 3:
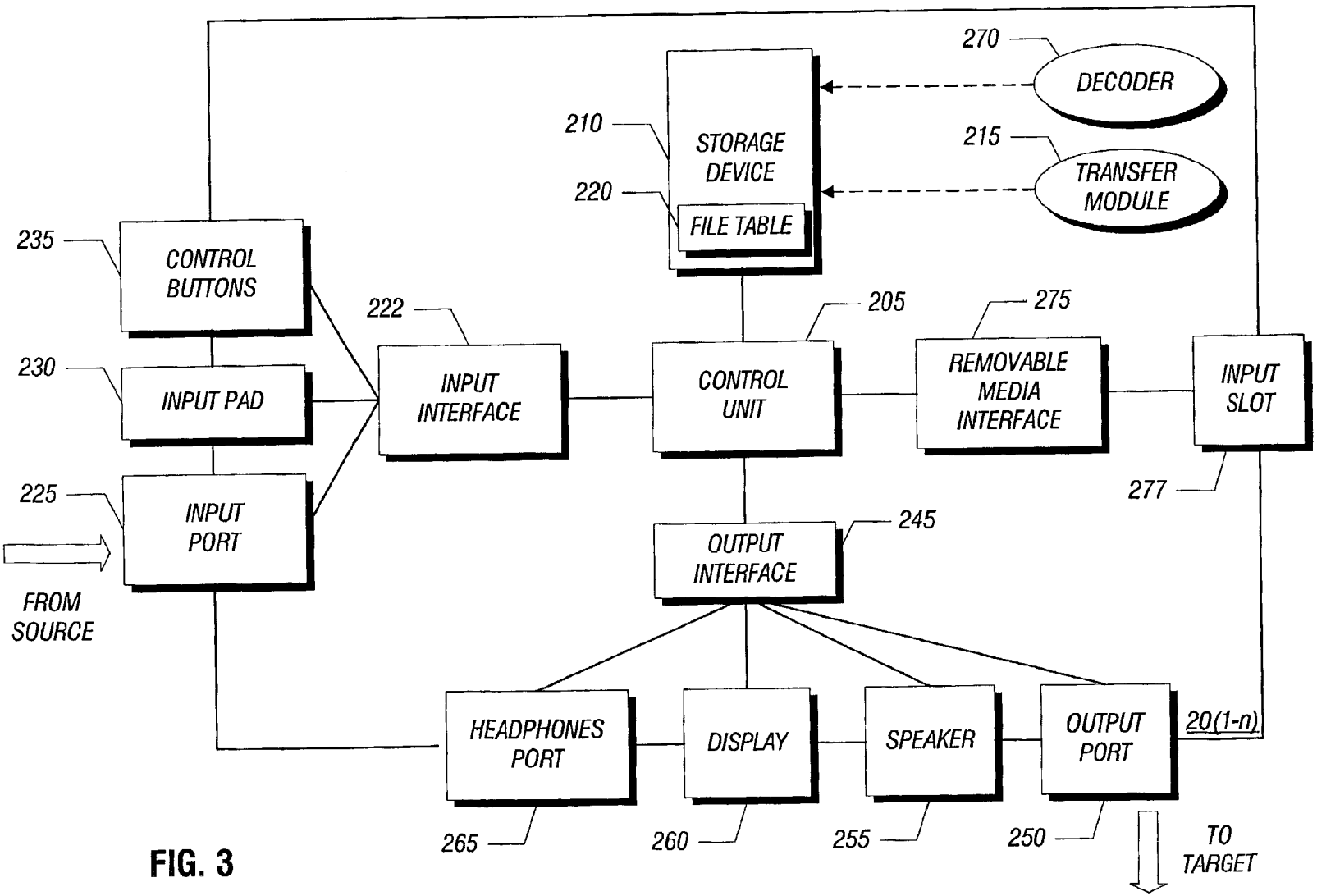
FIG. 3 is a block diagram of a portable device that may be employed in the communications system of FIG. 1, in accordance with one embodiment of the present invention.

Referring now to FIG. 3, a block diagram of the portable device **20(1-*n*) is illustrated, in accordance with one embodiment of the present invention. The portable device 20(1-*n*), in one embodiment, includes a control unit 205 that is communicatively coupled to a storage device 210, which, in one embodiment, may be one of a variety of forms of memory. As described in more detail below, the portable device 20(1-*n*) may include a transfer module 215 that is capable of transmitting one or more music files stored in the storage device 210 to other portable devices 20(1-*n*). In one embodiment, the portable device 20(1-*n*) may include a file table 220 (described in more detail below) that includes a listing of the stored music files and their associated transfer count. In one embodiment, the portable device 20(1-*n*) generates the file table 220 based on the music files stored in the storage device 210 and allows the contents of the file table 220 to be displayed on the display of the portable device 20(1-*n*). As described below with respect to FIGS. 5A–5C, the file table 220, in one embodiment, contains a list of the music files, as well as their associated transfer count, that are stored in the portable device 20(1-*n*). The transfer module 215 may also be stored in the storage device 210**, in one embodiment.

The portable device **20(1-*n*), in one embodiment, includes an input interface 222. The input interface 222, in one embodiment, may be an interface to a plurality of input elements, including an input port 225, input pad 230, and/or control buttons 235. The input port 225 may be any type of a port through which information may be received from other devices, including the host system 15 (see FIG. 1) and other portable devices 20(1-*n*). In an alternative embodiment, the portable device 20(1-*n*) may include a separate input port for interfacing the host system 15 and other portable devices 20(1-*n*). The input pad 230, in one embodiment, may allow a user to select one or more music files stored in the transmitting portable device 20(1) for transfer to at least one of the receiving portable devices 20(2-*n*). In another embodiment, the input pad 230 may include one or more scroll buttons that allow a user to scroll through a menu of options provided by the portable device 20(1-*n*). The control buttons 235, in one embodiment, may be buttons that allow a user to play, fast-forward, rewind, stop, and/or pause the music played on the portable device 20(1-*n*)**.

The portable device **20(1-*n*), in one embodiment, includes an output interface 245 that may serve as an interface to an output port 250, speaker 255, display 260, and/or headphones port 265. The output port 250** may be, for example, an IR port or a USB port, a line out port, and the like for linking to another portable device to transfer information in a manner described in more detail below.

The portable device **20(1-*n*), in one embodiment, includes a removable media interface 275 for accessing removable media (not shown) inserted by the user in an input slot 277**. Examples, of removable media may include mini disks, flash memory sticks, diskettes, and the like.

For clarity and ease of illustration, only selected functional elements of the portable device **20(1-*n*) are illustrated in FIG. 2, although those skilled in the art will appreciate that the portable device 20(1-*n*) may comprise additional functional elements. For example, the portable device 20(1-*n*) may include converters, such as analog-to-digital and digital-to-analog converters, for converting the music signals to a desired format. Additionally, it should be appreciated that FIG. 2 illustrates one possible configuration of the portable device 20(1-*n*) and that other configurations comprising different interconnections may also be possible without deviating from the spirit and scope of one or more embodiments of the present invention. For example, the input elements (e.g., input pad 230, control buttons 235) and output elements (e.g., display 260, speaker 255) of the portable device 20(1-*n*) may have separate respective input and output interfaces. It should be appreciated that one or more of the elements of the portable device 20(1-*n*)** may be implemented in software, hardware, or a combination thereof.

Figure 4:
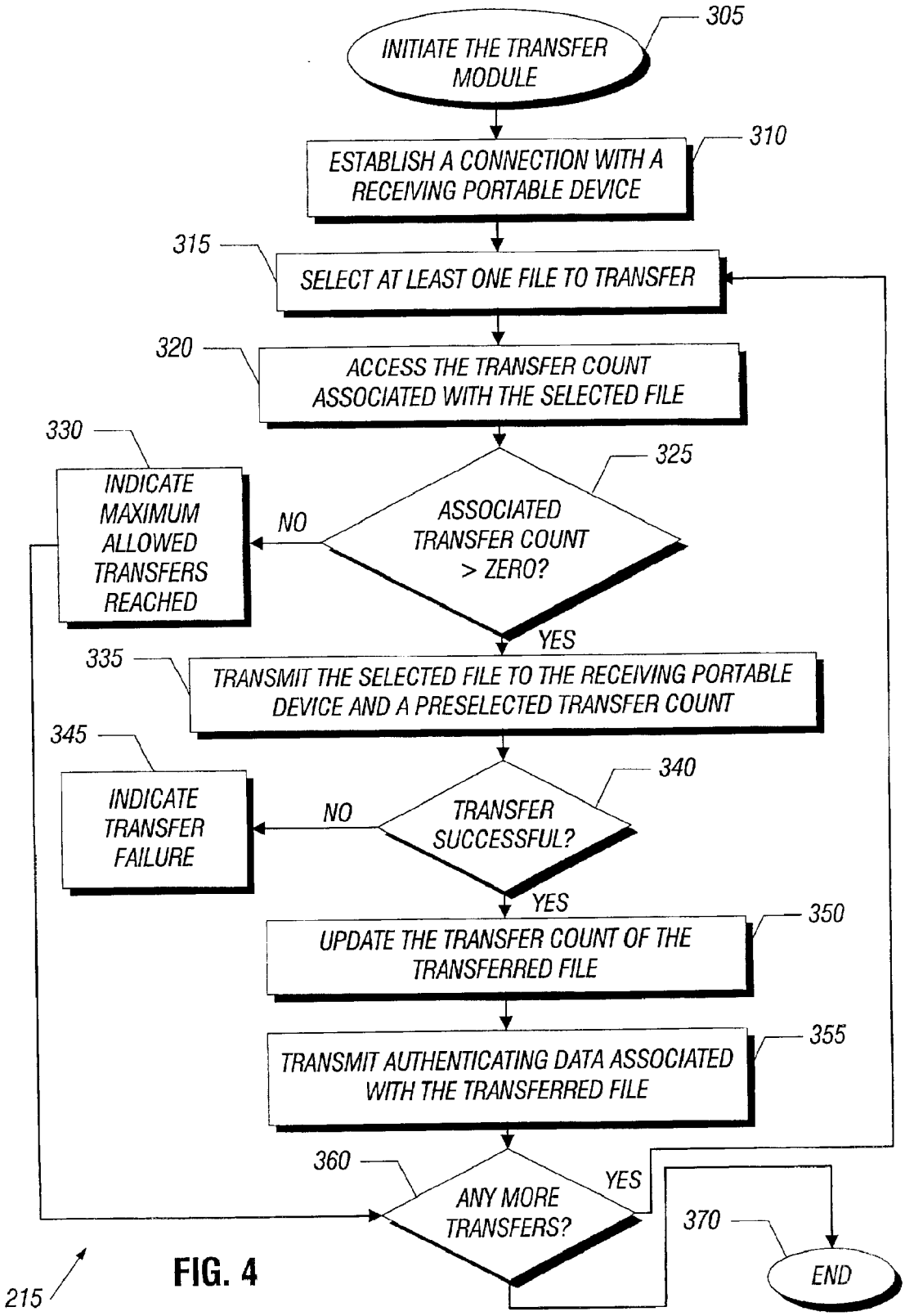
FIG. 4 is a flow chart of one embodiment of software resident on the portable device of FIG. 3.

Referring now to FIG. 4, a flow chart of one embodiment of software resident on the portable device of FIG. 2 is illustrated. In particular, FIG. 4 illustrates a flow chart of the transfer module 215 (see FIG. 2) of the portable device **20(1-*n*). Once the portable device 20(1) receives one or more music files from the host system 15 (as described in FIG. 2), the transfer module 215, in one embodiment, may transfer one or more of the stored music files from the transmitting portable device 20(1) to other receiving portable devices 20(1-*n*). Thus, the transfer of files may begin, in one embodiment, when the transfer module 215 is initiated (at 305**).

The transfer module 215 of the transmitting portable device 20(1) may establish (at 310) a connection with one of the receiving portable devices **20(2-*n*). In one embodiment, the transmitting portable device 20(1) may establish a wireless or wired peer-to-peer connection with the one or more of the receiving portable devices 20(2-*n*). In one embodiment, establishing (at 310) the connection may include the transfer module 215 of the transmitting portable device 20(1) establishing a secure connection with the transfer module 215 of one or more of the receiving devices 20(2-*n*). For example, if the transmitting portable device 20(1) is a SDMI-compliant portable device, the transfer module 215 of the transmitting module 20(1) may verify that the receiving device 20(2-*n*) is also SDMI-compliant. In one embodiment, the transmitting and receiving devices 20(1) and 20(2-*n*)** establish a secured authenticated channel using key negotiation.

A user may select (at 315) at least one music file to transfer to one or more of the receiving portable devices **20(2-*n*). In one embodiment, the user may use the input pad 230 (see FIG. 2) of the transmitting portable device 20(1) to select the at least one music file to transfer to one or more of the receiving portable devices 20(2-*n*). The input pad 230, for example, may allow the user to scroll through the stored music files on the transmitting device 20(1) and select at least one music file to transfer. Once at least one music file is selected (at 315), the transfer module 215, in one embodiment, accesses the transfer count associated with the selected (at 320) music file. The transfer count, in one embodiment, may represent the number of times one or more of the receiving portable devices 20(2-*n*) may further transfer the received music file. In one embodiment, the transfer count may be stored in the storage device 210 (see FIG. 3) of the transmitting device 20(1)**.

The transfer module 215 determines (at 325) if the transfer count associated with the selected music file is greater than zero. As described below, each time a music file is transferred, the transfer module 215 reduces the transfer count by one to indicate that the number of allowed transfers has been reduced by one. If the transfer module 215 determines (at 325) that the associated transfer count is not greater than zero, then the transfer module, in one embodiment, indicates (at 330) to the user that the maximum allowed transfers for that music file have been reached. In one embodiment, the transfer module 215 may display a message on the display 260 of the transmitting portable device 20(1) indicating that the number of allowed transfers for that music file has been reached.

If, however, the transfer module 215 determines (at 325) that the associated transfer count is greater than zero (i.e., additional transfers may be allowed), then the transfer module 215, in one embodiment, transmits (at 335) the selected file, as well as a preselected transfer count, to one or more of the receiving portable devices **20(2-*n*). In one embodiment, the music file may be transmitted as an encrypted file, where the encryption complies with the SDMI specification's requirements to encrypt or protect the content over one of a variety of transport mediums. A key (e.g., unique sequence of bits), for example, may be used to decrypt the encrypted file, in one embodiment. The preselected transfer count value, in one embodiment, represents the number of times one or more of the receiving portable devices 20(2-*n*) may further transmit the received file to other portable devices 20(1-*n*). In one embodiment, the transfer module 215 of the transmitting portable device 20(1) transmits a preselected transfer count of zero to prevent the receiving portable device 20(1-*n*)** from further transferring the received music file to other devices.

The transfer module 215 determines (at 340) if the transfer (at 335) from the transmitting portable device 20(1) to one or more of the receiving portable devices **20(2-*n*) was successful. If the transfer module 215 determines (at 340) that it was not successful, then the transfer module 215 may indicate (at 345) that the transfer failed. In one embodiment, a transfer failure indicating message may be displayed on the display 260 of the transmitting device 20(1), or, alternatively, an audio message indicating transfer failure may be played on the speaker 255 or through the headphones port 265**.

If the transfer module 215 determines (at 340) that the transfer was successful, then the transfer module 215, in one embodiment, updates (at 350) the transfer count associated with the transferred file by decrementing it by one. As mentioned, by decrementing the transfer count by one, the overall number of transfers allowed for that music file is reduced. In one embodiment, the transfer count is updated after the transfer module 215 determines (at 340) that the transfer was successful. It may be desirable to first verify that the transfer of the music file is successful before updating the transfer count to ensure that the transfer count is reduced only upon a successful transfer.

The transfer module 215 of the transmitting portable device 20(1), in one embodiment, transmits (at 355) authenticating data associated with the transferred file. That is, in one embodiment, the transfer module 215 may transmit a key to decrypt (if desired) the music file received by one or more of the receiving portable devices **20(2-*n*)**.

The transfer module 215 of the transmitting portable device 20(1), in one embodiment, determines (at 360) if the user wishes transfer additional music files. If so, the user is allowed to select (at 315) at least one file for transferring. The process may then be repeated, in one embodiment, until the user has transferred all the desired files. Once the desired files have been transferred from the transmitting portable device 20(1) to one or more of the receiving portable devices **20(2-*n*), the process ends (at 370**), in one embodiment.

As mentioned, in one embodiment, if the transfer module 215 determines (at 325) that a user has reached the allowed transfers for a given music file, the transfer module 215 may indicate (at 330) to the user that the maximum allowed transfers have been reached. After the indication (at 330), the transfer module 215 may determine (at 360) if the user wishes to transfer additional files, in one embodiment. If so, the user may be allowed to select (at 315) other music files, in one embodiment.

Referring now to FIGS. 5A–5C, one embodiment of the file table 220 that may be stored on the portable device **20(1-*n*) of FIG. 3 is illustrated. Specifically, as described in more detail below, FIG. 5A illustrates sample contents of the file table 220 (see FIG. 3) before selected music files are transferred from the transmitting portable device 20(1) to one or more of the receiving portable devices 20(2-*n*). FIG. 5B illustrates sample contents of the file table 220 of the transmitting device 20(1) after the selected files are transferred to one or more of the receiving portable devices 20(2-*n*). FIG. 5C illustrates sample contents of the file table 220 of one or more of the receiving devices 20(2-*n*) after the selected files are transferred from the transmitting portable device 20(1)**.

In one embodiment, the contents of the file table 220 may be accessed by the user on the portable device **20(1-*n*) so that the user may view how many music files are stored in the portable device 20(1-*n*), the title of each music file, and the transfer count associated with that music file. In alternative embodiments, additional information or fewer information may be included in the file table 220**, depending on the implementation.

Referring to FIG. 5A, the file table 220 includes a plurality of entries **420(1-*m*), where, in one embodiment, each of the plurality of entries 420(1-*m*) includes a music file number, the title of (or other identifier for) the music file, and a transfer count associated with that music file. The file table 220 of FIG. 5A illustrates, in one embodiment, current (e.g., before a file transfer) content of the music files stored in the storage device 210 of the transmitting device 20(1). As can be seen, for example, the first entry 420(1) includes a music identifier "first music file" having a transfer count of four, which, in the illustrated embodiment means that the music file, "first music file," may be transferred four more times to one or more of other portable devices 20(2-*n*). Similarly, the second entry 420(2) indicates that the music file, which has a transfer count of two, may be transferred two more times to one or more of the receiving portable devices 20(2-*n*). The third entry 420(3)** indicates that the third music file, "third music file," may be transferred two times, as indicated by a transfer count of two.

For illustrative purposes, it is herein assumed that a user selects "first music file" and "second music file" to transfer from the transmitting portable device 20(1) to one or more of the receiving portable devices **20(2-*n*). Further, assuming that once the selected files are transferred to one or more of the receiving portable devices 20(2-*n*), it is desired that no further transmissions of the selected files should be allowed from one or more of the receiving portable devices 20(2-*n*) to other devices. Once the two selected files are successfully copied to one or more of the receiving devices 20(2-*n*), the transfer module 215 of the transmitting portable device 20(1) updates the transfer count of the transferred files, as shown in FIG. 5B. As such, FIG. 5B illustrates revised contents of the file table of one or more of the transmitting portable devices 20(1) after the transfer. As can be seen in the entries 420(1) and 420(3) of FIG. 5**B, the transfer count of "first music file" is three and the transfer count of "third music file" is one, which means that "first music file" may now be transferred only three more times and "third music file" only one more time. Since in the illustrated embodiment the other music files were not transferred, the transfer count for these files remains the same, in one embodiment.

In one embodiment, as discussed above, the transmitting portable device 20(1) transmits a transfer count along with the two music files. Because no further transmissions of the music files, "first music file" and "third music file," are allowed in the illustrated example, the transmitting portable device 420(1) transmits a transfer count of zero for each of these music files to prevent any further transfers.

FIG. 5C illustrates the contents of the file table 220 on the receiving device **20(2-*n*) after the transfer. As can be seen, FIG. 5C includes a plurality of entries 420(1-*g*), where the first two entries include the music files that were transferred from the transmitting portable device 20(1). The transfer count of the entries 420(1-2) of the file table 220 of FIG. 5C is zero, which means that these files may not be further transferred by the receiving portable device 20(2-*n*) to other devices. However, as can been seen, the third entry 420(3), along with other entries (e.g., 420(*g*)) have a non-zero transfer count, which may be either because a non-zero transfer count was transmitted when these files were received from other portable devices 20(1-*n*), or, alternatively, these files may have been received directly from the host system 15 (see FIG. 1**) that may have transmitted non-zero transfer counts, thereby allowing further transfer of these files.

Although in the illustrated embodiment a transfer count is used to track the number of allowed file transfers, in alternative embodiment other indications may be used to control the number of allowed file transfers. For example, a separate counter may be used to count the number of transfers, where the separate counter may then be used to compare against the maximum number of transfers allowed for that particular file. Similarly, other methods may be employed to track the number of allowed transfers that are consistent with the spirit and scope of one or more embodiments of the present invention.

Figure 6:
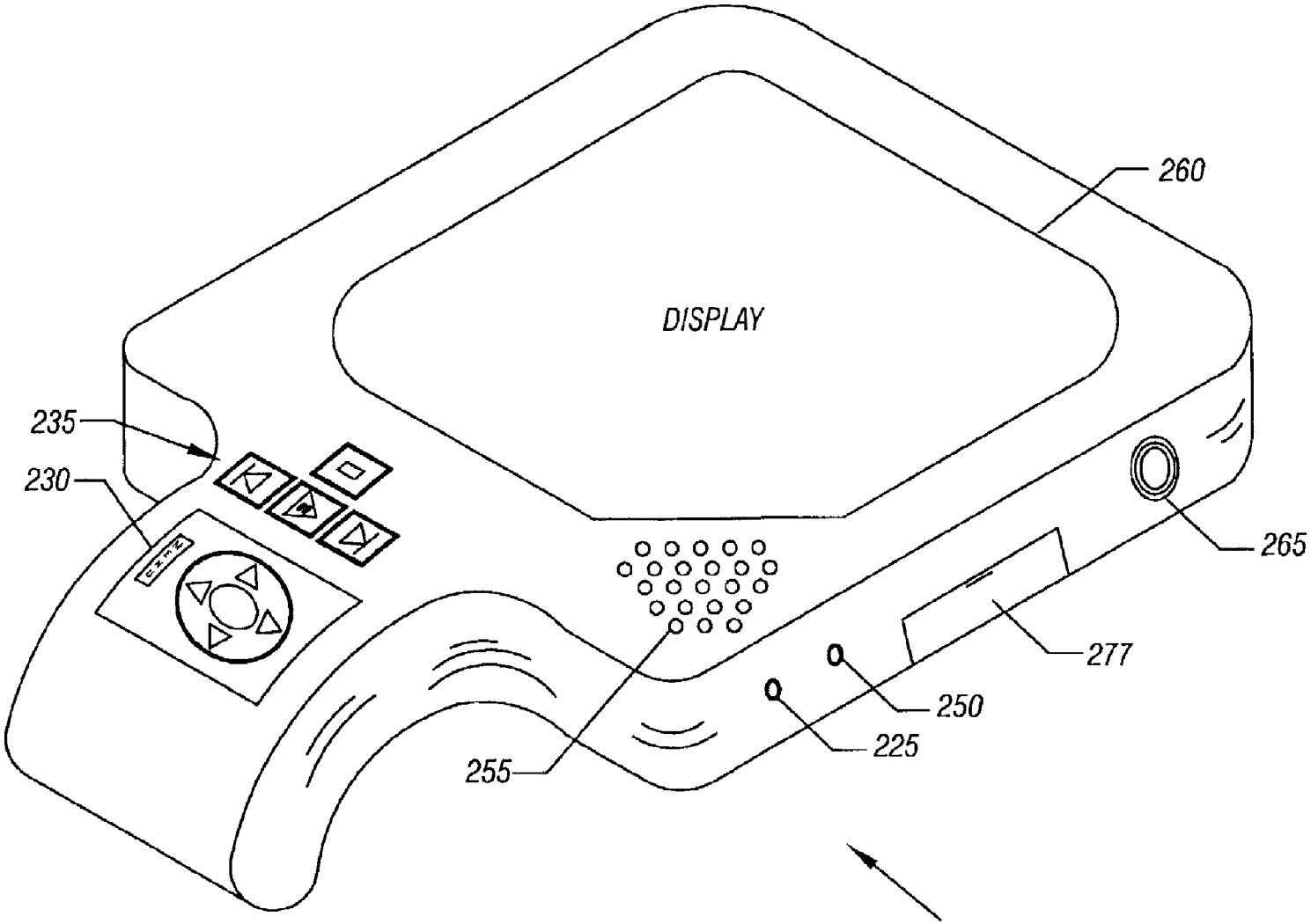
FIG. 6 is an isometric view of a portable device that may be used in the communication system of FIG. 1, in accordance with one embodiment of the present invention.

Referring now to FIG. 6, an isometric view of a portable device 510 is illustrated, in accordance with one embodiment of the present invention. The portable device 510, in one embodiment, may be the portable device **20(1-*n*) of FIG. 3. Although not so limited, in the illustrated embodiment, the portable device 510 is a music player, such as an MP3 music player. As shown, the portable device 510 includes the input port 225 that may receive one or more music files, as well as an associated transfer count with the music files, from external sources, such as the host system 15 (see FIG. 1), other portable devices 20(1-*n*), or any other suitable source. The output port 250 is provided for transferring one or more music files, as well as an associated transfer count with the music files, to external sources, such as other portable devices 20(1-*n*)**.

The portable device 510 includes the display 260 and input pad 230. The input pad 230 includes, in the illustrated embodiment, a menu button and a scrolling button. The menu button of the input pad 230 may, for example, cause a menu with selected options (e.g., transfer a music file) to be displayed on the display 260. The options in the menu button may be browsed using the scrolling button of input pad 230, in one embodiment. For example, a user may use the scrolling button of the input pad 230 to select a "transfer a music file" option to initiate the transfer process described above.

The portable device 510, in one embodiment, includes the control buttons 235 for playing, pausing, stopping, fast-forwarding, rewinding music files that may be stored in the portable device 510. The music played by the portable device 510 may be played from the speaker 255, or, alternatively, through the headphone port 265, in one embodiment.

In one embodiment, the portable device 510 includes the input slot 277 that may be capable of receiving removable media, such as flash memory sticks, mini disks, compact disks, digital video disks, diskettes, or any other media capable of storing music that may be played by the portable device 510. In one embodiment, the transfer count of a music file may be reduced each time a music file is transferred to a removable media (e.g., as opposed to another portable device over a connection).

The various system layers, routines, or modules may be executable control units (such as control units 16 and 205 (see FIGS. 1 and 3)). Each control unit may include a microprocessor, a microcontroller, a processor card (including one or more microprocessors or controllers), or other control or computing devices. The storage devices referred to in this discussion may include one or more machine-readable storage media for storing data and instructions. The storage media may include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy, removable disks; other magnetic media including tape; and optical media such as compact disks (CDs) or digital video disks (DVDs). Instructions that make up the various software layers, routines, or modules in the various systems may be stored in respective storage devices. The instructions when executed by a respective control unit cause the corresponding system to perform programmed acts.

The particular embodiments disclosed above are illustrative only, as the invention may be modified and practiced in different but equivalent manners apparent to those skilled in the art having the benefit of the teachings herein.

Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An article comprising one or more machine-readable storage media containing instructions that when executed enable a processor to:

receive at least one music file and a transfer count associated with the music file from another device, wherein the transfer count is indicative of the number of times the music file may be transferred to one or more devices;

store at least one of the music file and the associated transfer count;

allow the music file to be transferred to the one or more devices based on the transfer count;

reduce the transfer count by one in response to each successful transfer of the music file to the one or more devices; and transmit a preselected transfer count for the music file transferred to the one or more devices, wherein the preselected transfer count indicates the number of times the file may be transferred by the one or more devices.

2. The article of claim 1, wherein the instructions when executed enable the processor to transfer the preselected transfer count indicating that no further transfers by the one or more devices are allowed.

3. The article of claim 1, wherein the instructions when executed enable the processor to receive the transfer count embedded in the music file.

4. A method comprising:

receiving at a portable device at least one media file and a transfer count associated with the media file from another device, wherein the transfer count is indicative of the number of times the media file may be transferred to one or more devices from the portable device;

storing at least one of the media file and the associated transfer count on the portable device;

allowing the media file to be transferred to the one or more devices based on the transfer count;

reducing the transfer count by one in response to each successful transfer of the media file to the one or more devices; and transmitting a preselected transfer count for the media file transferred to the one or more devices, wherein the preselected transfer count indicate, the number of times the media file may be transferred by the one or more devices.

5. The method of claim 4, further comprising transferring the preselected transfer count indicating that no further transfers by the one or more devices are allowed.

6. The method of claim 4, further comprising receiving the transfer count embedded in the media file.

7. The method of claim 4, wherein the media file comprises a music file.

8. The method of claim 4, wherein allowing the media file to be transferred comprises wirelessly transmitting the media file from the portable device to the one or more devices.

9. An apparatus comprising:

an interface to communicate with a remote device; and a controller communicatively coupled to the interface, the controller to:

receive at least one media file and a transfer count associated therewith from the remote device, wherein the transfer count is indicative of the number of times the media file may be transferred to one or more devices;

store at least one of the media file and the associated transfer count;

allow the media file to be transferred to the one or more devices based on the transfer count;

reduce the transfer count by one in response to each successful transfer of the media file to the one or more devices; and transmit a preselected transfer count for the media file transferred to the one or more devices, wherein the preselected transfer count indicates the number of times the media file may be transferred by the one or more devices.

10. The apparatus of claim 9, wherein the controller is to transfer the preselected transfer count indicating that no further transfers by the one or more devices are allowed.

11. The apparatus of claim 9, wherein the controller is to receive the transfer count embedded in the media file.

12. The apparatus of claim 9, wherein the apparatus comprises a portable music player.

13. The apparatus of claim 9, wherein the remote device comprises a portable media player.

14. The apparatus of claim 12, further comprising a display to display an identification of media files on the portable music player.

15. The apparatus of claim 9, further comprising a removable media interface to receive a removable storage medium.

16. The apparatus of claim 15, wherein the controller is to reduce the transfer count if the media file is transferred to the removable storage medium.

* * * * *

UNITED STATES PATENT AND TRADEMARK OFFICE

CERTIFICATE OF CORRECTION

PATENT NO. : 6,989,484 B2
APPLICATION NO. : 09/836686
DATED : January 24, 2006
INVENTOR(S) : Mark T. Gross It is certified that error appears in the above-identified patent and that said Letters Patent is hereby corrected as shown below:

Column 9:
Line 52, "indicate" should be --indicates--.

Signed and Sealed this

Twenty-fifth Day of July, 2006

JON W. DUDAS
*Director of the United States Patent and Trademark Office*